United States Patent [19]

Taylor et al.

[11] 4,065,904

[45] Jan. 3, 1978

[54] SUPPORT SYSTEMS

[76] Inventors: Peter Taylor, 79 Norman Ave., Bradford; Brian Considine, The Spinney, Hall Drive, Bramhope, Leeds, both of England

[21] Appl. No.: 635,079

[22] Filed: Nov. 25, 1975

[30] Foreign Application Priority Data

Nov. 29, 1974 United Kingdom ..... 51809/74

[51] Int. Cl.[2] ..... E04H 17/16; E04H 17/18

[52] U.S. Cl. ..... 52/731; 108/108; 211/193; 248/245

[58] Field of Search ..... 52/243, 239, 36, 730, 52/27, 731, 241; 248/245; 211/190, 193; 108/108

[56] References Cited

U.S. PATENT DOCUMENTS

| | | | |
|---|---|---|---|
| 3,166,285 | 1/1965 | Downes | 248/245 |
| 3,189,140 | 6/1965 | Luss | 52/36 X |
| 3,193,061 | 7/1965 | Downes | 52/641 |
| 3,250,584 | 5/1966 | Tassell | 248/245 X |
| 3,261,625 | 7/1966 | Cripe | 52/239 |
| 3,513,606 | 5/1970 | Jones | 248/245 X |
| 3,901,612 | 8/1975 | Canin | 403/231 |

FOREIGN PATENT DOCUMENTS

| | | | |
|---|---|---|---|
| 485,923 | 2/1970 | Switzerland | 52/730 |

*Primary Examiner*—John E. Murtagh
*Attorney, Agent, or Firm*—Jay L. Chaskin

[57] ABSTRACT

A support system for use in partition walling and in supporting shelving and other elements. The system comprises an elongated post having a core, a face structure comprising a pair of spaced webs, each extending longitudinally of the post and delineating a longitudinally extending slot and sections joining the webs to the core and defining a space between the webs and the core. An elongated strip is a push fit within part of the space between the webs and the core, the strip having a part through which a series of longitudinally spaced locating holes are formed. The strip is shaped so that when fitted within said space said part lies behind said slot substantially parallel to the webs of the post and there is space left between said part and the core. This space may receive tabs on the ends of brackets shaped to interlock with the locating holes in the strip. Of particular advantage in the support system is a post wherein said space is defined by second webs extending into said space from said sections and delineating a second longitudinally extending slot aligned with the first slot. The second webs divide the space into a first area between the first and second webs and a second area between the second webs and the core, the depth of the first area being greater than that of the second area.

7 Claims, 14 Drawing Figures

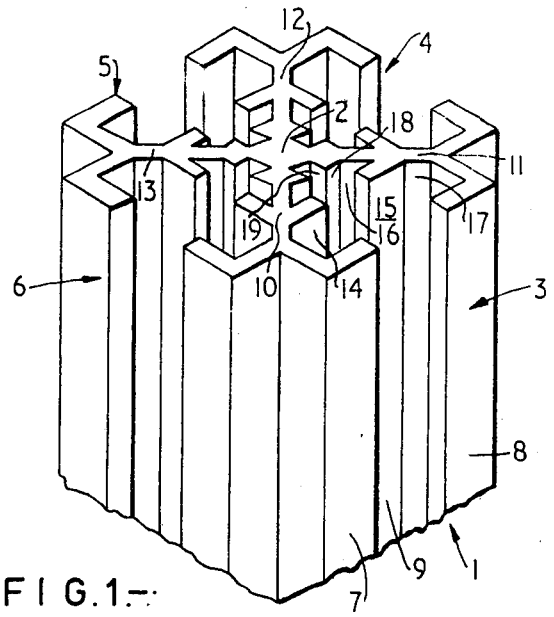
-FIG.1-
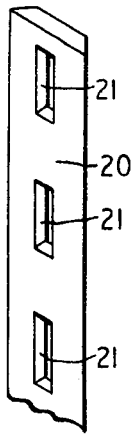
-FIG.2-
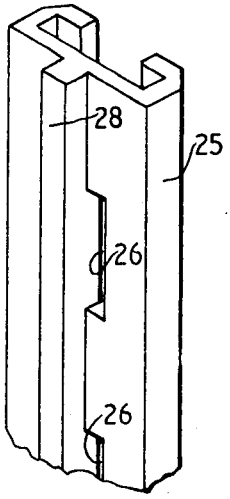
-FIG.3-

—FIG. 4—
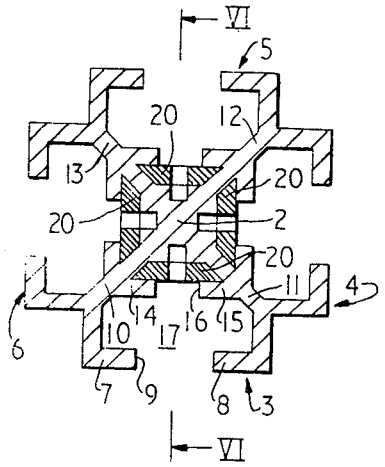
—FIG. 5—
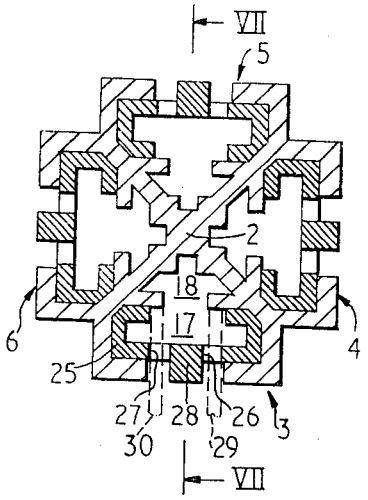
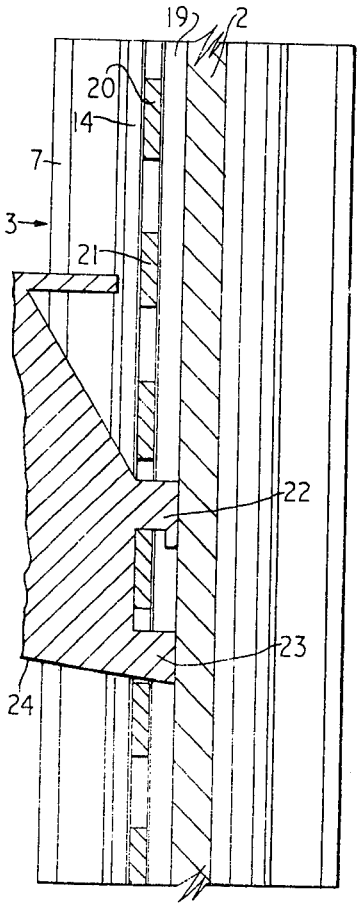
—FIG. 6—
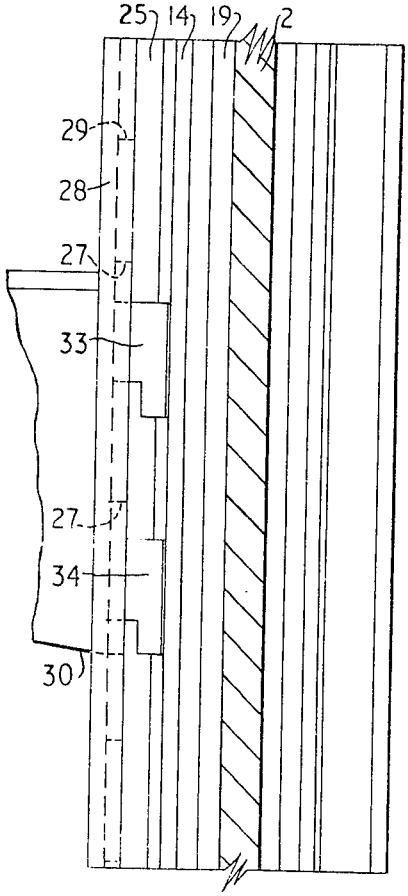
—FIG. 7—

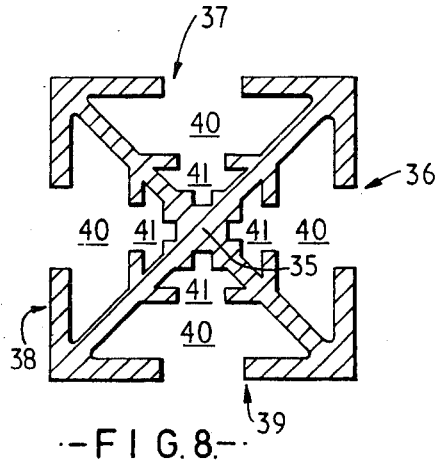
-FIG.8-
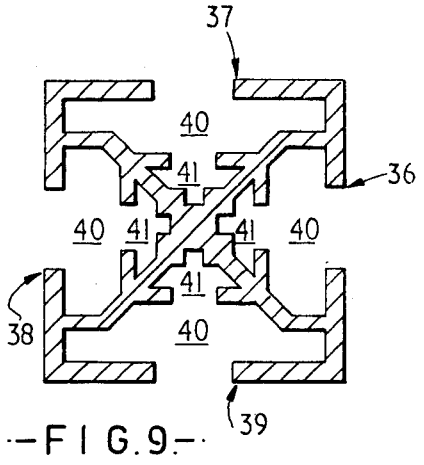
-FIG.9-
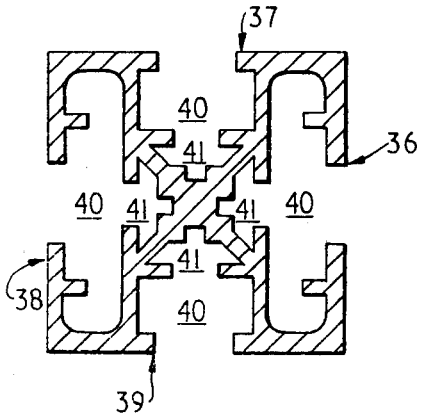
-FIG.10-
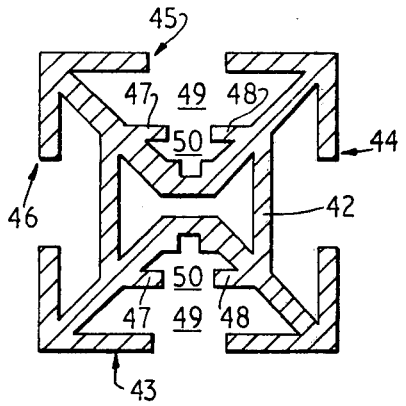
-FIG.11-
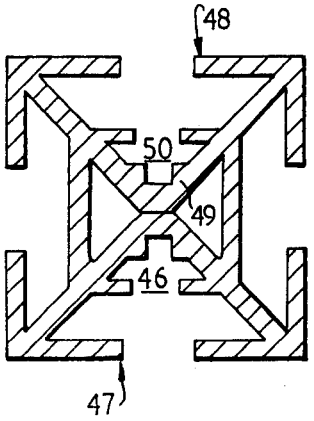
-FIG.12-

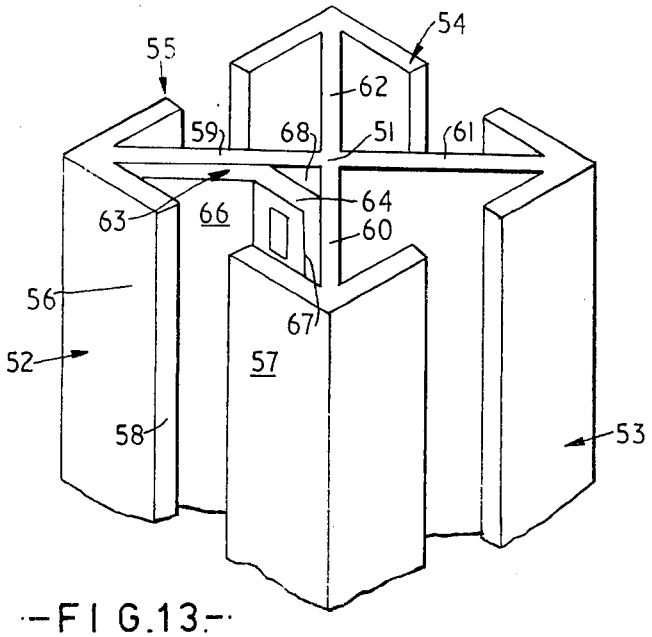
-FIG.13-
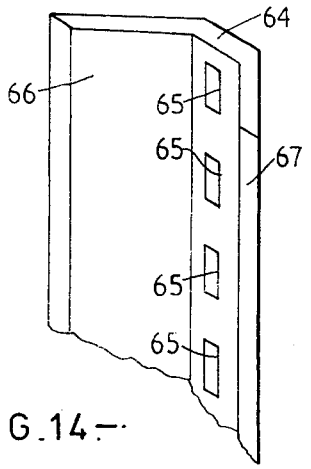
-FIG.14-

SUPPORT SYSTEMS

This invention relates to support systems for use in partition walling and in supporting shelving and other elements.

Many different forms of support systems are known for partition walling and these commonly include a support post constituted by an extruded aluminium section. The overall cross-section of the extrusion is generally substantially square, with each face having a central slot extending the entire length of the extrusion. Techniques for securing partitioning to such posts are well known and satisfactory. Problems are, however, encountered in securing brackets to such posts, for supporting shelves and other elements. In one common system brackets are provided with a toggle fitting for passing through the slot in a face and securing behind the webs to each side of the slot. The securing is effected by a screw and the system is considered disadvantageous in that accurate levelling of the brackets and ensuring that the brackets are exactly square to the post are difficult, and that fitting of the brackets is time consuming.

According to the present invention a support system for use in partition walling and in supporting shelving and other elements comprises an elongated post having a core, a face structure comprising a pair of spaced webs each extending longitudinally of the slot and delineating a longitudinally extending slot, and sections joining the webs to the core and defining a space between the webs and the core; and an elongated strip which is a push fit within part of the space between the webs and the core, the strip being formed with a part which lies substantially parallel to the webs of the post and through which a series of longitudinally spaced locating holes are formed, and the strip being shaped so that when fitted within said space said part lies behind said slot and there is space left between said part and the core.

A system according to the invention is extremely versatile. The post can be used in support of conventional partitioning and brackets as already described. However, when the strip is combined with the post this can provide positive support for brackets without the need for a toggle fitting. Thus, the end of a bracket may be inserted through the slot between the pair of webs, and tabs on the end of the bracket fitted into spaced locating holes in the strip, and passing through these holes into the space between the strip and the core. The tabs will be shaped to interlock with the locating holes in the strip to hold the bracket firmly in position without the need for any screw fitting. Thus, the combination of a support post with a slotted strip fitted thereto, allows positive support for the brackets, while the system also enables conventional partitioning and fittings to be used, the strip being withdrawn from the post if necessary.

In one form of the invention the post also has second webs extending into said space from said sections, lying parallel to said first webs, delineating a second longitudinally extending slot aligned with the first slot, and dividing said space into a first area between said first and second webs and a second area between said second webs and said core, said second area opening into a groove in, and extending the full length of, the core.

Depending on the type of bracket to be supported strips may be inserted into either the first area or the second area. Strips for insertion into the first area may have one or two adjacent series of locating holes therein, while strips for insertion in the second area will generally only have one series.

A support post for use in the invention may have one or more face and web structures associated with a single core. In particular it is advantageous if the post is of substantially square cross section overall and if there are four face structures as aforesaid, each delineating a longitudinal slot. Any one or more of the face structures may then have the associated second pair of spaced webs as aforesaid, and the structures may be arranged symmetrically around the core.

The invention also extends to a support post for use in the support system, the post having a core, a face structure comprising a pair of spaced webs each extending longitudinally of the post and delineating a longitudinally extending slot, sections joining the webs to the core and defining a space between the webs and the core, second webs extending into said space from said sections, lying parallel to the first webs, delineating a second longitudinally extending slot aligned with the first slot, and dividing said space into a first area between said first and second webs and a second area between said second webs and said core, said second area opening into a groove in, and extending the full length of, the core, and the depth of said first area being greater than that of said second area.

When the space is divided into two areas in this way it is advantageous that the relative depths be as stated, as the first area can then be sufficiently deep to accommodate both the strip and those parts of tabs on the end of brackets which pass through the locating holes in the strip to ensure that the bracket is securely locked. Furthermore, the depth is such as to accommodate a considerable depth of bracket flange. The brackets may then be of aluminium and will have sufficient strength to carry heavy loads.

Preferably the depth of the second area is not less than that of the groove, as again this leads to optimum support for brackets fitted to the strip. Furthermore it is desirable that the groove be narrower than the slot delineated by the second webs, and that this slot be narrower than the slot delineated by the first webs. Again, this particular relationship leads to good support and stability of the bracket as the tabs of a bracket fitted to a strip in the first area may abut the second webs and the tabs of a bracket fitted to a strip in the second area may abut the edges and back face of the groove.

Support posts for use in the invention may be made in a large number of different cross sections, and may be of extruded aluminium or other material.

In order that the invention may be better understood, some specific embodiments thereof will now be described in more detail, by way of example only, with reference to the accompanying drawings, in which:

FIG. 1 is a perspective view of a first form of support post;

FIGS. 2 and 3 are perspective views of different forms of strips which may be used with the post of FIG. 1;

FIGS. 4 and 5 are cross-sections of the post of FIG. 1 with the strips of FIG. 2 or 3 respectively;

FIGS. 6 and 7 show the use of brackets with the post and strip combinations of FIGS. 4 and 5 respectively;

FIGS. 8 to 12 show cross-sections of other forms of support posts;

FIG. 13 shows a further post and strip combination; and

FIG. 14 shows in more detail the strip of FIG. 13.

Referring now to FIGS. 1 to 7 a support post 1 comprises a core 2 and four face structures 3 to 6. Each face structure is formed by a pair of spaced first webs extending longitudinally of the post and delineating a first longitudinally extending slot. Thus, face structure 3 is formed by two webs 7, 8 delineating slot 9. The webs of the face structures are joined to the core by diagonal web sections 10 to 13. From these diagonal web sections further webs project into the spaces between the face structures and the core. Thus, behind face structure 3 there is a second pair of spaced webs 14, 15 delineating a second longitudinally extending slot 16 and dividing the space between face structure 3 and core 2 into first and second areas 17, 18. The second area 18 opens into a groove 19 extending the full length of the core. In a similar manner there is a second pair of webs behind each of the other face structures. The depth of the first area 17 is greater than the depth of the second area 18, and the depth of the area 18 is substantially equal to the depth of the groove 19. The groove 19 is narrower than the slot 16, which is in turn narrower than the slot 9.

FIG. 2 shows a strip 20 which may be fitted into any one of the second areas such as 18, and FIG. 4 shows the post with four such strips fitted. Each strip is designed to be a push fit into the second area, and can be held in location by self-tapping screws passed through the strip and into the core. Each strip 20 is formed with a series of spaced locating slots 21 into which tabs 22, 23 on the end of a bracket 24 may be fitted as shown in FIG. 6, the tabs being shaped to interlock with the slots in well known manner to give positive location and firm support. The tabs project through the slots 21 and into the groove 19, and the firm support for the bracket is enhanced by the engagement of the tabs with the sides and base of the groove 19.

FIG. 3 shows a strip 25 which may be fitted into any one of the first areas such as 17, and FIG. 5 shows the post with four such strips fitted. Each strip is designed to be a push fit into the first area and in particular to have parts which lie juxtaposed to the junction between each web and its respective joining section. Again, the strip may be held by self-tapping screws engaging the cores. Each strip 25 is formed with two series of spaced locating slots 26, 27 separated by a longitudinally extending rib 28. Brackets 29, 30 may be fitted by tabs 31, 32 and 33, 34 respectively engaged with separate series of the slots, and it is thus possible to fit two brackets side by side at the same level, separated by the rib as shown in FIG. 7. The tabs project through the locating slots to the position shown where they engage the second webs 14 and 15 to add further stability.

Clearly it is only practical to use either strip 20 or strip 25 with any given face of the post, and the strips to be used are selected and positioned as required depending on the function of the post.

FIGS. 8 to 10 show alternative cross-sections for the post of the invention. In all figures the post has a core 35 and four face structures 36 to 39. Behind each face structure is a second pair of webs, so forming four first areas 40 and four second areas 41 which may receive strips similar to those shown in FIGS. 3 and 2 respectively.

FIG. 11 shows a post having a core 42 and four face structures 43 to 46. Behind face structures 43, 45 there are second pairs of webs 47, 48 so forming first areas 49 and second areas 50 which may receive strips similar to those shown in FIGS. 3 and 2 respectively. However, there are no such pairs of webs behind faces 44, 46 so that in the case of this post it is only possible to fit strips as shown in FIG. 2 behind faces 43 and 45.

FIG. 12 shows a structure similar to that of FIG. 11, but in this case the post is extruded without a complete core structure so forming only a single second area 46 behind face structure 47. A similar area can be formed behind face structure 48 by fitting a separately extruded core section 49 as shown to define second areas 50.

FIGS. 13 and 14 show a further form of post and strip. In this case the post has a core 51 with which are associated four face structures 52 to 55 each formed by a pair of spaced webs such as 56 and 57, extending longitudinally of the post and delineating a longitudinally extending slot 58. Diagonal web sections 59 to 62 join the face structures to the core. The strip 63 for use in conjunction with this post has a central part 64 in which is formed a series of longitudinally spaced locating slots 65, and two side parts 66, 67 the tips of which lie juxtaposed to the junctions between the webs 56 and 57 and their respective diagonal joining sections 58 and 59. The strip 63 is a push fit into the space between the webs and the core, and is shaped so that a space 68 is left between the central part 64 and the core 57. Thus, a bracket may be fitted to the strip 63 in a similar manner to the way that bracket 24 is fitted to strip 20, as shown in FIG. 6, and the tabs of the bracket will project into the space between the webs and the core.

It will be appreciated that posts and strips of other cross-sections can also be used in the performance of the invention.

We claim:

1. A support system, comprising an elongated post having a core, a face structure comprising a first pair of spaced webs each extending longitudinally of the post and delineating a first longitudinally extending slot, sections joining said webs to said core, second webs extending from said sections and delineating a second longitudinally extending slot aligned with said first slot, said second webs dividing the space between said first webs and said core into a first area between said first and second webs and a second area between said second webs and said core, the second area opening into a groove in, and extending the full length of, said core; and an elongated strip which is a press fit into the second area from one end of the post, said strip being formed with a part through which a series of longitudinally spaced locating holes are formed, and said strip being shaped so that when press fitted within said second area said part is aligned with said slots and said groove remains unoccupied, the strip having surfaces in frictional engagement with the associated webs and joining sections which define said second area.

2. A support system as claimed in claim 1 wherein the depth of said first area is greater than that of said second area.

3. A support system as claimed in claim 1 wherein the depth of said second area is no less than the depth of said groove.

4. A support system as claimed in claim 1 wherein the groove is narrower than the second slot and the second slot is narrower than the first slot.

5. A support system as claimed in claim 1 wherein said support post has more than one face and web structure, each being joined to said core.

6. A support system as claimed in claim 5 wherein there are four face and web structures arranged symmetrically around said core.

7. A support system as claimed in claim 1 wherein the strip has a cross-section which is substantially identical to the cross-section of said second area.

* * * * *